United States Patent [19]

Sakoda

[11] Patent Number: 4,788,395

[45] Date of Patent: Nov. 29, 1988

[54] CONFIGURATION FOR JOINING COMPONENTS OF A MICROWAVE OVEN

[75] Inventor: Yasuhiko Sakoda, Wakayama, Japan

[73] Assignee: Sharp Kabushiki Kaisha, Osaka, Japan

[21] Appl. No.: 913,611

[22] Filed: Sep. 29, 1986

Related U.S. Application Data

[63] Continuation of Ser. No. 724,187, Apr. 17, 1985, abandoned.

[30] Foreign Application Priority Data

Jun. 15, 1984 [JP] Japan ..... 59-89597[U]

[51] Int. Cl.[4] ..... H05B 6/64

[52] U.S. Cl. ..... 219/10.55 R; 219/10.55 E; 312/236; 29/513

[58] Field of Search ..... 219/10.55 R, 10.55 E, 219/10.55 D; 126/273 R; 312/257 SM, 257 R, 100, 236; 29/512, 513, 523

[56] References Cited

U.S. PATENT DOCUMENTS

| | | | |
|---|---|---|---|
| 1,750,833 | 3/1930 | Carns | 29/512 |
| 2,092,505 | 9/1937 | Gort | 29/512 X |
| 2,996,790 | 8/1961 | Trafford | 29/513 X |
| 3,083,773 | 4/1963 | Nagel et al. | 29/513 |
| 3,640,556 | 2/1972 | Bennett | 29/513 X |
| 3,867,605 | 2/1975 | Yee | 219/10.55 D |
| 3,909,919 | 10/1975 | Miyabayashi et al. | 29/513 X |
| 4,159,406 | 6/1979 | Tate et al. | 219/10.55 D X |
| 4,282,416 | 8/1981 | White | 219/10.55 R |
| 4,563,559 | 1/1986 | Enami | 219/10.55 DX |

*Primary Examiner*—Philip H. Leung

*Attorney, Agent, or Firm*—Birch, Stewart, Kolasch & Birch

[57] ABSTRACT

A microwave oven structure whose constituent members can be easily and firmly assembled without using a spot-welding process. In given mating members to be joined, through-holes are formed in one of the mating members and squeezed or cut-and-raised projections are formed on the other mating member at positions corresponding to the through-holes whereby the mating members are joined with each other by rolling-over method in which the projections are inserted into the through-holes and caulked by rolling over or bonding the projections.

8 Claims, 7 Drawing Sheets

CONFIGURATION FOR JOINING COMPONENTS OF A MICROWAVE OVEN

This application is a continuation of application Ser. No. 724,187 filed on Apr. 17, 1985, now abandoned.

BACKGROUND OF THE INVENTION

The present invention relates to a microwave oven structure.

In general, a microwave oven has a double wall structure consisting of an interior member (a heating chamber) and an exterior member.

The construction of a conventional microwave oven is shown in FIG. 9.

As shown, a sheet member is bent into a groove-shaped three sided member 3*a* having side walls 5*a* and 7*a* and a bottom wall 6*a*, each of the side walls including connection flanges 9*a*, 9*b* and 9*c* in front, upper and rear ends respectively. A separately manufactured top panel 4*g* is placed on top of the three sided member 3*a* so that the left end of the former meets the upper end of the left side wall. The three sided member 3*a* is connected with the top panel 4*g* by spot welding the connection flanges 9*c* to the top panel 4*g* at the corresponding portions facing the connection flanges, thereby forming an oven body. Then, a separately manufactured front panel 11*c* including an opening 14 is positioned so that the edge of the opening 14 coincides with the front end edge of the oven body, and fixed to the oven body by spot welding at the connection flanges 9*a*. Similarly, a rear panel 13*b* is positioned on the rear end of the oven body so as to face the front panel 11*c*, and fixed to the oven body by spot welding at the connection flanges 9*b*. The bottom panel 12*a* is also fixed to the front panel 11*c* and to the rear panel 13*b* at their bottom ends by screws. Further, a waveguide 1 is placed on the top panel 4*g* so as to enclose waveguide openings 8 formed in the top panel 4*g* and fixed thereto by spot welding at connection flanges 2 of the waveguide 1.

Thus, in the conventional microwave oven structure, the constituent members are assembled with each other mainly by spot welding between the connection members.

This assembling method has various inconveniences: Defective spot welding can occur. Furthermore, the press operation for forming each member and welding operation for assembling are quite different processes and performed at different workshops, causing inefficient production procedure. In addition, since precoated steel plate cannot be welded as it is, it must be subjected to necessary treatment.

One of the solutions to the above problem in the assembly by welding is shown in FIG. 10(*a*), in which members A and B have respective bent ends A' and B' which are engaged with each other, the member B being further bent to be at a right angle with the member A. Another solution is shown in FIG. 10(*b*) in which, in the engagement between the members A and B as shown in FIG. 10(*a*), the member B is further bent by 180° around the bent portions A' and B'. The connecting methods shown in FIGS. 10(*a*) and 10(*b*) which are employed in can manufacturing are not applicable to the connections between the waveguide 1 and the top panel 4*g* nor between the three-sided member 3*a* and the rear panel 13*b*, because the top panel 4*g* and the rear panel 13*b* are not provided with flanges to be engageable with the connection flanges 2 of the waveguide 1 and the connection flanges 9*b* of the three-sided member 3*a*, respectively.

Accordingly, the methods shown in FIG. 10(*a*) and 10(*b*) are not applicable for all connections. To employ these methods, it is essential that the ends of one member meet the ends of the mating member. If the methods are to be employed for connection between two members whose end edges do not meet, auxiliary mounting members (not shown) must be provided on the members, resulting in further complicated construction.

OBJECT AND SUMMARY OF THE INVENTION

The object of the present invention is to provide a microwave oven structure whose constituent members are easily and firmly assembled without the need for a spot welding process.

In the microwave oven structure according to the present invention, through-holes are formed in one of mating constituent members to be connected, and projections are formed by squeezing or cutting and raising on the other constituent member at the corresponding positions to the through-holes. The two members are connected with each other by a rolling-over method, that is, by inserting the projections into the through-holes and caulking by rolling over or bending the projections preferably, an end of the member to be connected is folded into two layers on which the projections are formed.

DETAILED DESCRIPTION OF THE INVENTION

An embodiment of the invention will now be described in detail with reference to the drawings.

Figure 1A:
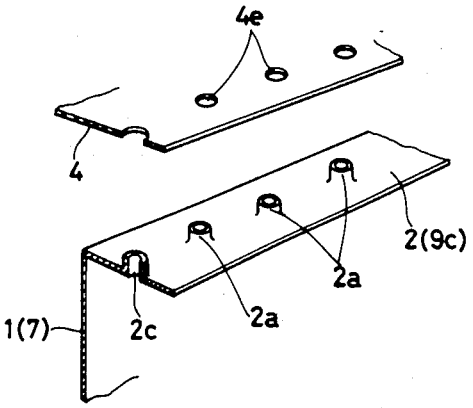
FIG. 1(*a*) is a perspective view of the primary connecting parts (as disassembled) of a microwave oven structure according to the present invention, FIG. 1(*b*) is a perspective view of the connecting parts shown in, FIG. 1(*a*), as assembled, FIG. 2(*a*) is a perspective view of the primary connecting parts (as disassembled) of a microwave oven structure according to another example of the present invention, FIG. 2(*b*) is a perspective view of the assembled connecting parts shown in FIG. 2(*a*), FIG. 3(*a*) is a perspective view of the primary connecting parts (as disassembled) of a microwave oven structure according to a further example of the present invention, FIG. 3(*b*) is a perspective view of the assembled connecting parts shown in FIG. 3(*b*), FIG. 4(*a*) is a perspective view of the primary connecting parts (as disassembled) of a microwave oven according to still further example of the present invention, FIG. 4(*b*) is a perspective view of the assembled connecting parts shown in FIG. 4(*a*).
Figure 1B:
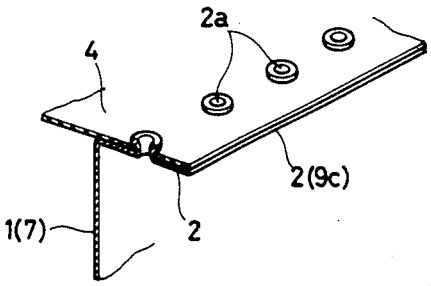
Figure 5:
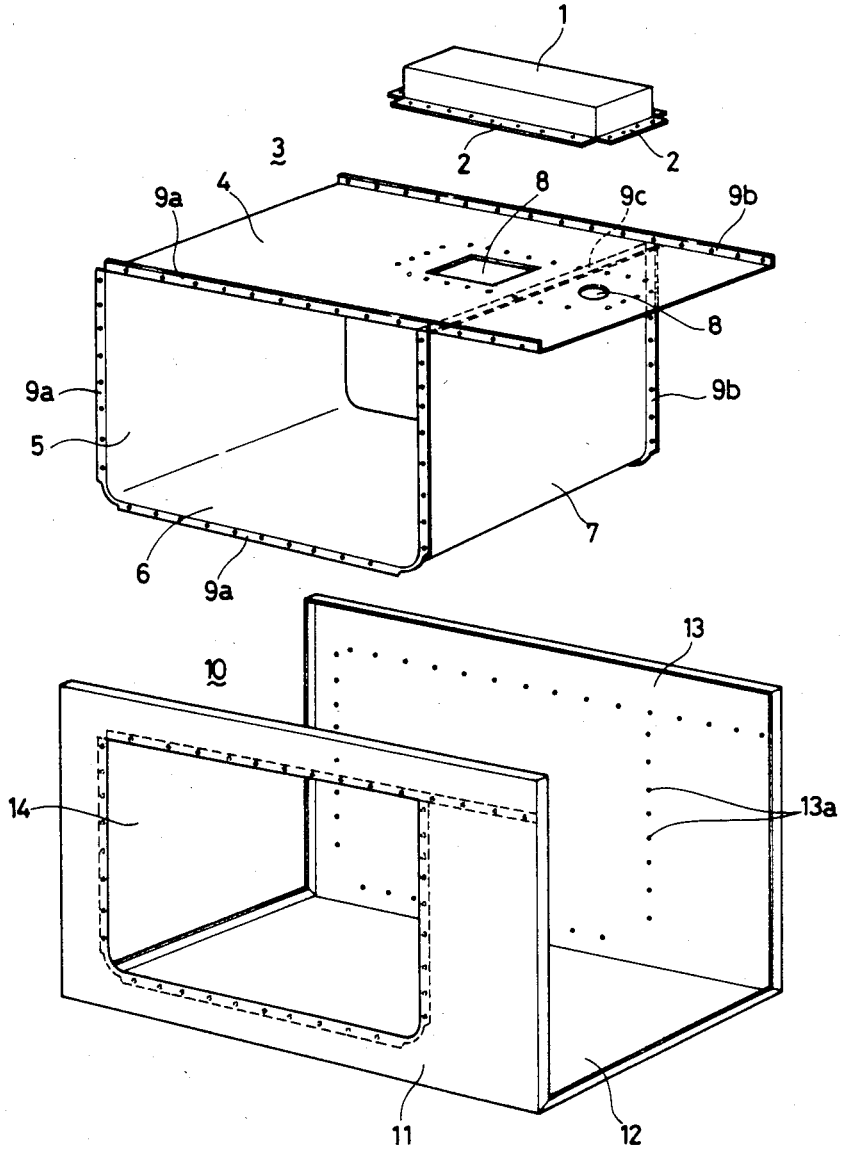
FIG. 5 shows the disassembled member, in perspective view, of a microwave oven structure to be assembled by any of the above connecting means.

As illustrated in FIG. 5, the microwave oven structure of the present invention consists of a waveguide 1 leading microwave into the oven, an oven body 3 and an exterior cover 10. The oven body 3 is a square cylinder made of a sheet material which is bent to define a top wall 4 of the largest width, a left side wall 5, a bottom wall 6 and a right side wall 7, the end of the right side wall 7 being positioned between two waveguide openings 8 formed about the axial center in the top wall. Through-holes 4e, 4e . . . are provided at regular intervals in the top wall at the portion facing a connecting flange 9c formed by bending the end of the right side wall 7, and squeezed projections 2a, 2a . . . are formed at the same intervals as the through-holes 4e, 4e . . . on the connection flange 9c, as shown in FIGS. 1(*a*) and 1(*b*). The projections 2a, 2a . . . are inserted into the through-holes 4e, 4e . . . and caulked for fixing the right side wall 7 to the top wall 4.

The waveguide 1 is of a shallow square case with an open side, the four end edges being bent to define connection flanges 2, 2 . . . the waveguide 1 is also fixed to the top wall 4 by inserting and caulking the projections 2a, 2a . . . into the through-holes 4e, 4e . . . formed surrounding the two waveguide openings 8.

The through-holes 4e are round in the above example. Alternatively, they may be square through-holes 4f (FIG. 2(*a*)), and cut and raised projections 2b may be provided instead of the squeezed projection 2a (FIG. 2(*b*)).

Figure 3A:
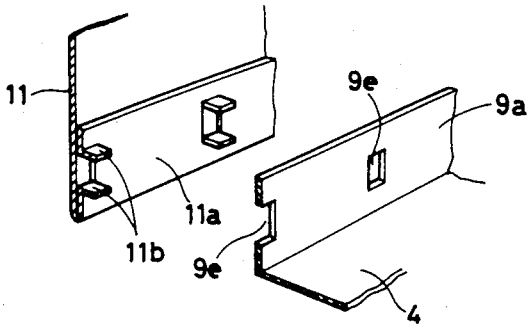
Figure 3B:
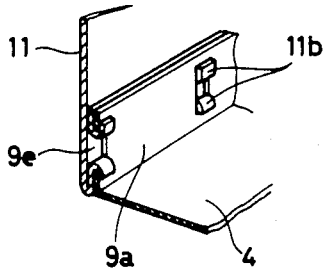

The exterior cover 10 consists of a front wall 11 having an opening 14 for putting or extracting cooked objects in or from the oven, a bottom wall 12 and a rear wall 13 continuously formed by bending a sheet material. The exterior cover 10 is mounted on the oven body 3 with the front and rear wall ends being matched with the front and rear ends of the oven body 3 respectively, and fixed to the same through connection flanges 9a, 9a . . . and 9b, 9b . . . formed by bending the front and rear end portions of the oven body 3, as shown in FIGS. 3 and 4.

Specifically, the front wall 11 is fixed to the front end of the oven body 3 by inserting pairs of cut and raised projections 11b formed on the folded end portions 11a of the front wall 11 into corresponding through-holes 9e provided in the connection flanges 9a of the oven body 3 and bending the ends of the projections 11b outwardly.

Figure 4A:
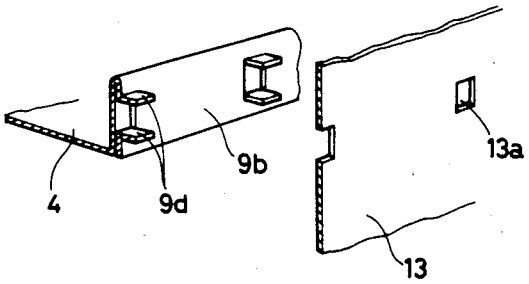
Figure 4B:
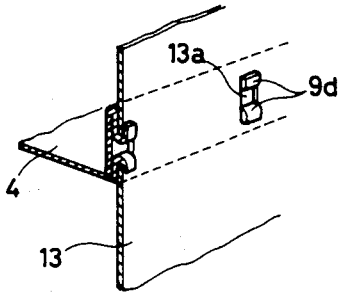

The rear end of the top wall 4 has a double-folded flange 9b on which pairs of cut and raised projections are formed as shown in FIG. 4(*a*). The rear wall 13 is fixed to the oven body 3 by inserting the pairs of cut and raised projections 9d into corresponding square through-holes 13a formed in the rear wall 13 and bending the ends of the projections 9d outwardly.

Figure 6:
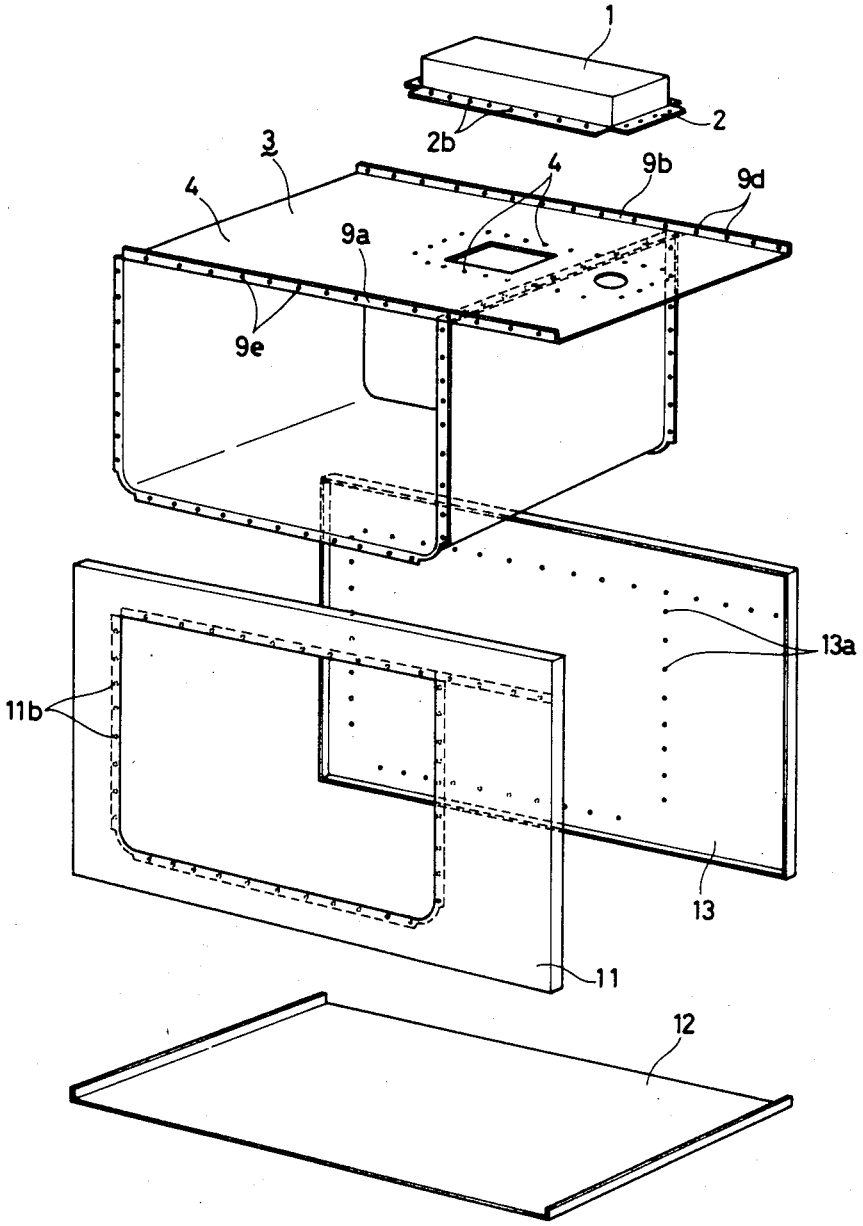
FIG. 6 is a view similar to that of FIG. 5 and illustrates another example of an oven structure.

As mentioned above, for connection between two members, round or square through-holes are formed in one of the mating members and squeezed or cut and raised projections are provided on the other member at the positions corresponding to the through-holes. The projections are inserted and caulked into the through-holes. According to this connection means, independent front panel 11 and rear panel 13 can be directly connected to the ends of the oven body 3 without any auxiliary connection member, as shown in FIG. 6. Also, in the connections shown in FIGS. 1 and 2, the projections 2c and 2d are inserted into the through-holes 4e and 4f for connection, leaving holes communicating through the two mating members.

If it is not desirable to leave such holes, the end portions of the front panel may be double folded, and cut and raised projections 11b or 9d or squeezed projections 2a shown in FIG. 1(*a*) may be formed on the double folded end portions as shown in FIGS. 3 and 4. Thus, the through-holes can be completely closed. The squeezed or cut and raised projections can be formed in any portion of the members.

Figure 7:
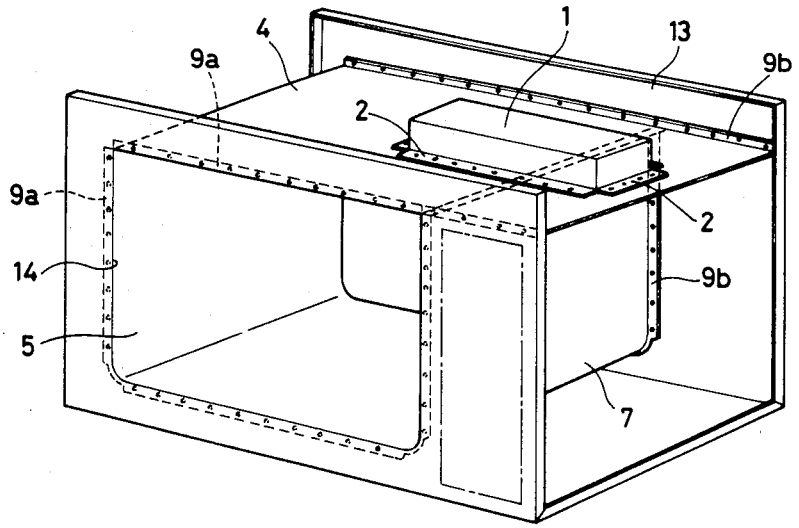
FIG. 7 shows the assembled microwave oven in perspective view.
Figure 8:
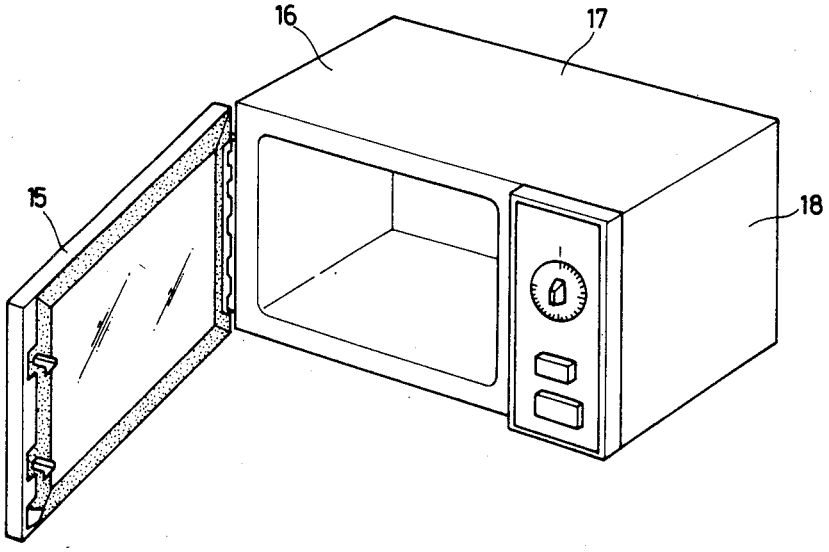
FIG. 8 is a perspective view of the completed microwave oven, with the exterior cover mounted on the above assembled oven.
Figure 9:
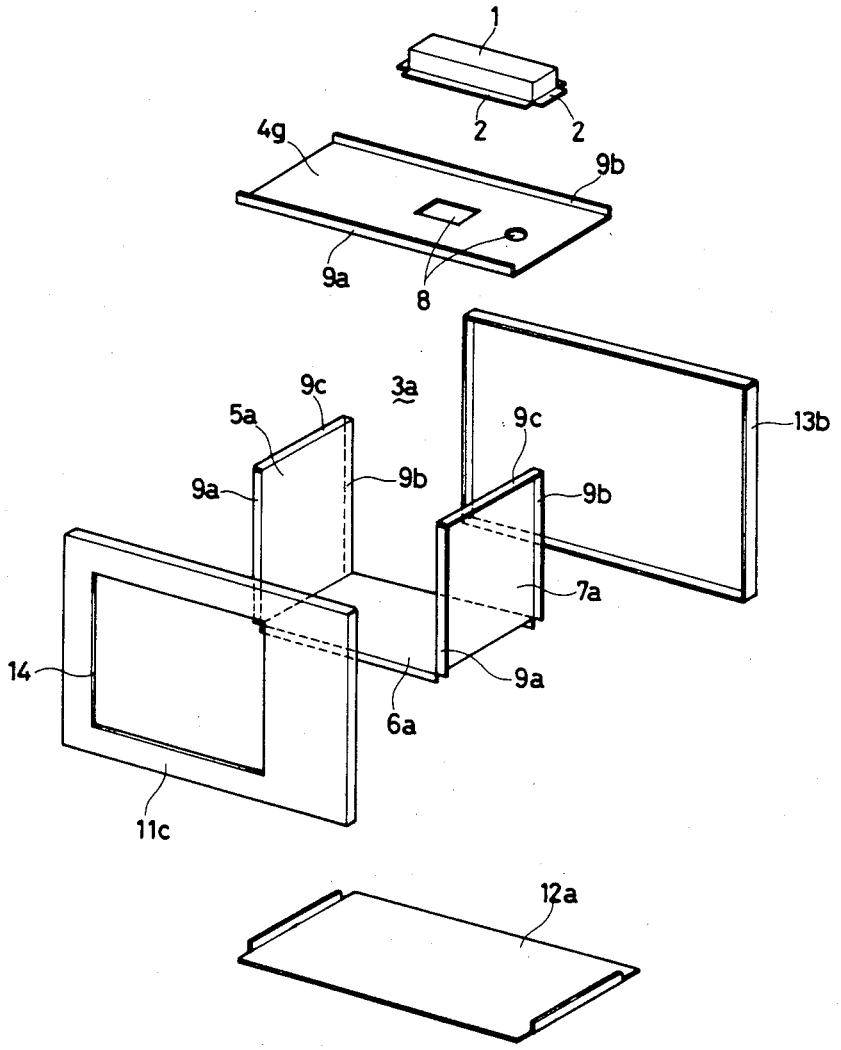
FIG. 9 PRIOR ART
FIG. 9 is a perspective view of a conventional microwave oven as disassembled, FIG. 10(*a*) is a perspective view showing an example of connecting members in the conventional oven structure, and FIG. 10(*b*) shows another connecting member in perspective view of the conventional oven structure.
Figure 10:
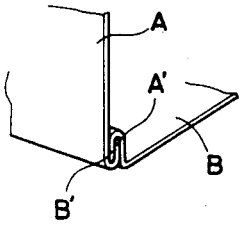
FIG. 10 (a) PRIOR ART
Figure 10:
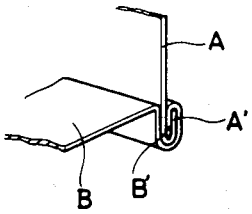
FIG. 10 (b) PRIOR ART

FIG. 7 is an assembled oven according to the present invention, in perspective view. FIG. 8 is a perspective view of a completed microwave oven with the exterior cover mounted on the above assembled oven.

In FIG. 8, reference numbers 16, 17 and 18 denote the exterior cover bent into a saddle shape, and the number 15 denotes the front door of the microwave oven.

According to the present invention, two members are connected with each other by rolling over the joining parts. Therefore, it is not only possible to connect the end portions of two members but also possible to connect the end portion of one member with the other member between the ends.

Figure 2A:
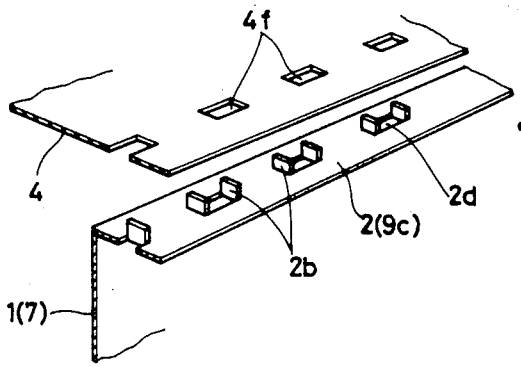
Figure 2B:
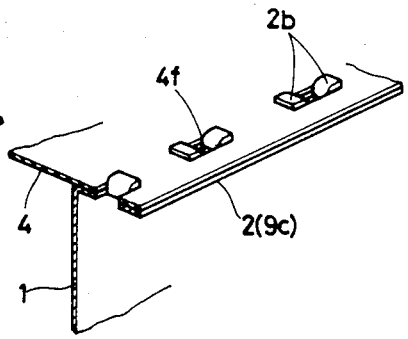

For the connections shown in FIGS. 1 and 2, projections may be provided on either of the two members, depending upon the location and surrounding conditions. For connections shown in FIGS. 3 and 4 in which the end portion of one member is double-folded to close the through-holes, however, the squeezed projections 2a or the cut and raised projections 2b must be provided on the member 11 or the top panel 4 having the folded end. The folded end can close the through-holes, ensuring an air-tight connection. The connection strength can be enhanced by reducing the interval of the through-holes and the corresponding projections.

As mentioned above, since the rolling-over method is employed for connection between the constituent members of the present invention, it is possible to interconnect any type of metal plates including coated metal plates such as precoated steel plates. Furthermore, unlike a welding method which can cause incomplete connection, the mechanical connection employed in the present invention ensures a product having a constant quality.

In addition, unlike the connecting methods in can manufacturing, the connecting method employed in the present invention is applicable to a joint at any portion of the members. Moreover, the present invention involves a press operation alone for production and therefore can be manufactured in one workshop, which promises high productivity with the necessity of advanced techniques and accordingly reduced personnel expenses. Besides, the assembling process is energy saving and economical because it does not involve a welding operation.

The invention having been thus described it is obvious that the same may be modified in many ways. Such modifications are intended to be included within the scope of this disclosure.

What is claimed is:

1. A microwave oven structure having its constituent components thereof joined by an interlocking configuration, comprising:

a sheet material bent to define a top, a first bottom, and two side walls each having first mating members formed about their edges and an exterior cover of at least one sheet material defining a front, a second bottom and a rear wall having corresponding second mating members positioned to engage said first mating members;

at least one of said first and second mating members having openings therein and the remaining of said first and second corresponding mating members having a folded end portion, said end portion being provided with projections which are inserted into said openings and pressed to be parallel with said folded end portion to form said interlocking configuration.

2. The microwave oven structure of claim 1, wherein said openings are holes and said projections are cylindrical.

3. The microwave oven structure of claim 1, wherein said openings are rectangular in shape and said projections are rectangular.

4. The microwave oven structure of claim 1, wherein said exterior cover is bent to form a U-shaped member.

5. The microwave oven structure of claim 1, further including a waveguide member joined to said top wall of said sheet material.

6. The microwave oven structure of claim 1, wherein said top of said sheet material is longer than said first bottom and has an extending portion which extends beyond one of said side walls.

7. The microwave over structure of claim 6, wherein a waveguide member is joined to said top wall with a portion of said member being located on said extending portion.

8. The microwave oven structure of claim 1, wherein said folded end portion is formed as a double-folded flange.

* * * * *